US007753240B2

(12) United States Patent
Leoncavallo et al.

(10) Patent No.: US 7,753,240 B2
(45) Date of Patent: Jul. 13, 2010

(54) CLOSURE FOR A LIQUID CONTAINER

(75) Inventors: Richard A. Leoncavallo, Niagara Falls, NY (US); John D. DeLorme, Spencerport, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 722 days.

(21) Appl. No.: 11/342,080

(22) Filed: Jan. 27, 2006

(65) Prior Publication Data

US 2007/0175931 A1 Aug. 2, 2007

Related U.S. Application Data

(63) Continuation-in-part of application No. 29/224,096, filed on Feb. 24, 2005, now Pat. No. Des. 543,454.

(51) Int. Cl.
*B65D 47/00* (2006.01)
*B65D 39/00* (2006.01)
*B65D 43/14* (2006.01)

(52) U.S. Cl. ..... 222/556; 222/562; 222/550; 222/498; 220/592; 220/841; 220/254.3; 215/235; 215/354; 215/395

(58) Field of Classification Search ..... 222/556, 222/562, 563, 498, 533, 567, 568, 545, 546, 222/548, 550, 551, 554, 557; 220/592, 810, 220/840, 254.3, 324, 841–845, 847, 848; 221/63; 215/354, 344, 395, 396, 398, 235, 215/236

See application file for complete search history.

(56) References Cited

U.S. PATENT DOCUMENTS 175,811 A 4/1876 Wright
1,850,894 A * 3/1932 Punte et al. ..... 220/810
2,051,815 A * 8/1936 Booth ..... 222/556
2,263,446 A * 11/1941 Sebell ..... 220/842
2,764,199 A * 9/1956 Tupper ..... 220/254.3
2,889,087 A * 6/1959 Paull et al. ..... 222/498
2,950,847 A * 8/1960 Tupper ..... 222/465.1
D194,890 S 3/1963 Marler
D196,458 S 10/1963 Uderwood et al.
3,113,693 A 12/1963 Stull
D206,029 S 10/1966 Stull
3,297,132 A * 1/1967 Ripple ..... 198/378
3,390,804 A * 7/1968 Morgan ..... 220/212
3,741,447 A 6/1973 Miles et al.
4,456,135 A 6/1984 Beekes
5,088,614 A * 2/1992 Dumestre ..... 220/713

(Continued)

*Primary Examiner*—Kevin P Shaver
*Assistant Examiner*—Stephanie E Tyler
(74) *Attorney, Agent, or Firm*—Wood, Herron & Evans, LLP

(57) ABSTRACT

A closure for a liquid container includes a spout and a loop member extending upwardly from an end wall of the closure. The loop may be sized to receive a user's finger or attachment hardware such as a clip, hook or strap extending through the loop. A flip cap is supported for rotational movement on the loop and is movable between a closed position in which the spout is covered and an open position in which the spout is exposed. The flip cap includes a plug seal that is configured to engage and seal with a top edge of the spout when the cap is moved to the closed position.

37 Claims, 5 Drawing Sheets

U.S. PATENT DOCUMENTS

| | | | | | |
|---|---|---|---|---|---|
| D336,247 | S | | 6/1993 | Solomon | |
| 5,305,900 | A | * | 4/1994 | Maguire et al. | 215/245 |
| 5,320,232 | A | * | 6/1994 | Maguire et al. | 215/245 |
| 5,328,058 | A | * | 7/1994 | Leoncavallo et al. | 222/153.14 |
| 5,417,350 | A | | 5/1995 | Koo | |
| 5,603,436 | A | | 2/1997 | Leoncavallo et al. | |
| D417,339 | S | | 12/1999 | Miller | |
| 6,039,207 | A | | 3/2000 | Adamek | |
| D422,503 | S | | 4/2000 | Lehn | |
| 6,132,227 | A | | 10/2000 | Boteler et al. | |
| 6,170,683 | B1 | * | 1/2001 | Montgomery | 215/235 |
| D445,684 | S | | 7/2001 | Key | |
| 6,261,026 | B1 | * | 7/2001 | Conley et al. | 403/397 |
| 6,644,487 | B2 | * | 11/2003 | Smith et al. | 215/235 |
| D505,294 | S | | 5/2005 | Gauss | |
| 7,044,317 | B2 | * | 5/2006 | Smith et al. | 215/235 |
| 2004/0089627 | A1 | | 5/2004 | Smith et al. | |
| 2004/0217139 | A1 | | 11/2004 | Roth et al. | |

* cited by examiner

CLOSURE FOR A LIQUID CONTAINER

The present application is a continuation-in-part of U.S. Design Ser. No. 29/224,096 filed Feb. 24, 2005, now U.S. Design Pat. No. D543,454, the disclosure of which is hereby incorporated herein by reference in its entirety.

FIELD OF THE INVENTION

The present invention relates generally to liquid containers and, more particularly, to a closure for use with a liquid container to provide selective dispensing of liquid from within the container.

BACKGROUND OF THE INVENTION

Various types of bottles or containers have been developed in the past that include a closure to provide selective dispensing of liquid from the container. Typically, the closure is removably attached to the neck of the container so a user can remove the closure to add liquid, powders, ice or other products into the container. The closure is then screwed or snapped onto the neck of the container to provide a generally watertight and leak-proof seal.

When a user desires to drink liquid from the container, the closure may be removed by unscrewing the closure to provide access into the reservoir of the container. The user drinks from an opening formed by the neck of the container and then replaces the closure onto the container to re-seal the container.

For outdoor activities, such as biking or hiking for example, it is oftentimes desirable to have a closure provided with a push/pull type spout. With this type of spout, a slidable or movable spout portion is mounted on a stem portion wherein the spout portion may be pulled in an upward direction to open the spout and pushed in a downward direction to close the spout. A flip top protective cover may be mounted to the closure to protect the spout from damage or contamination from dirt or other debris when the cover is closed. The spout is accessed by moving the cover to an open position to thereby expose the spout which is then opened by the user by pulling on the spout.

While the closure types described above provide many advantages to users, especially those involved in sports, hiking or other activities, there is still a need for an improved closure having a liquid dispensing opening or spout that allows the closure to be readily grasped by a user or attached to another article through suitable attachment hardware while providing a cover for the opening or spout. There is also a need for an improved closure that provides quick and convenient access to, and/or opening of, the opening or spout with minimal manipulation of the closure by a user.

SUMMARY OF THE INVENTION

The present invention overcomes the foregoing and other shortcomings and drawbacks of liquid container closures heretofore known for dispensing of liquid from within the container. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a closure is provided for use with a liquid container to provide selective dispensing of liquid from the container. The closure is configured to be removably secured to a neck of the container and provide an essentially watertight and leak-proof seal with container neck.

In one aspect of the present invention, the closure may include a spout extending upwardly from an end wall of the closure. The spout has an outlet opening in fluid communication with the container reservoir so that liquid pours out of the spout when a user tilts the container.

In accordance with another aspect of the present invention, the closure includes a loop member extending upwardly from the end wall of the closure that defines an opening therethrough. The loop may be sized to receive a user's finger or attachment hardware such as a clip, hook or strap extending through the loop. In this way, the container is easily grasped by a user by inserting a finger through the loop. The container is also readily attachable to another article, such as a backpack or a user's article of clothing, by inserting attachment hardware through the loop.

According to another aspect of the present invention, a flip cap is provided on the closure to selectively cover the spout when the spout is not in use. The flip cap is supported for rotational movement on the loop and is movable between a closed position in which the spout is covered and an open position in which the spout is exposed. In one embodiment, the flip cap includes a pair of opposing arcuate connector members for releasably engaging the loop. The loop isolates the connector members from a user's finger or attachment hardware passing through the loop so that the user's finger or attachment hardware does not interfere with movement of the flip cap or cause unintentional opening of the flip cap.

In another aspect of the present invention, the flip cap may include a plug seal that is configured to engage and seal with a top edge of the spout when the flip cap is moved to the closed position to cover the spout. The plug seal automatically sealingly engages the spout to prevent undesired leakage of liquid from the spout when the flip cap is closed.

In yet another aspect of the present invention, the closure includes an outlet opening formed in the end wall of the closure. The outlet opening is configured so that liquid pours out of the outlet opening when the user tilts the container. The flip cap may be configured to cover, and possibly seal, the outlet opening when flip cap is closed.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
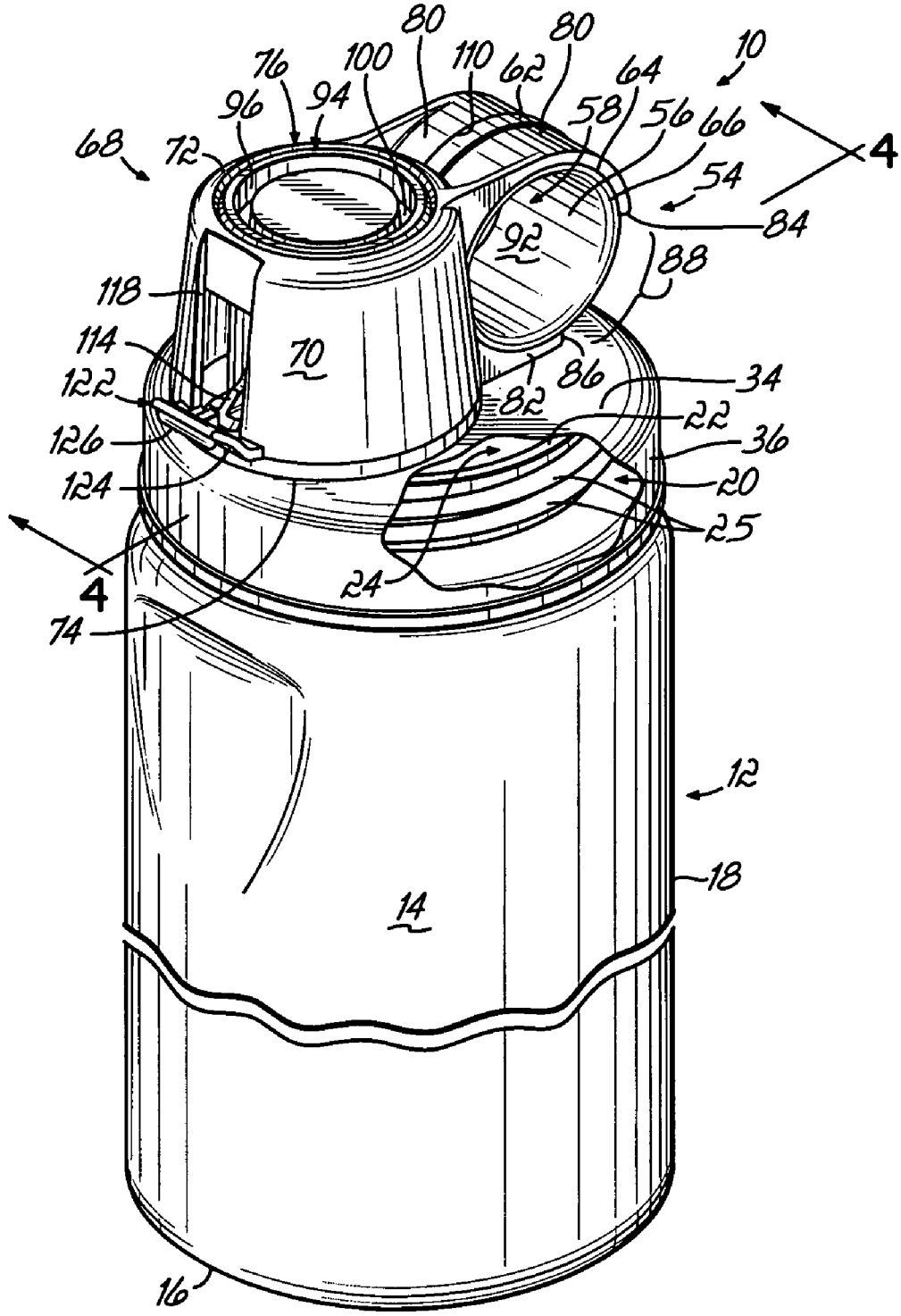
FIG. 1 is a perspective view of a closure in accordance with one embodiment of the present invention for use with a liquid container, showing a front, top and right side of the closure and container and a flip cap of the closure oriented in a closed position.

Referring now to the figures, a closure 10 having a novel and visually distinctive appearance is shown in accordance with the principles of the present invention for use with a liquid container 12. Container 12 is shown in an exemplary embodiment including a container body 14 having a base 16 and an upwardly extending sidewall 18 defining an interior reservoir for receiving and storing liquids therein. The container 12 further includes a neck 20 opposite the base 16 and has a top edge 22 defining an opening 24 into the reservoir of the container 12 as shown in FIG. 1. In one embodiment, the container neck 20 has external threads 25 (FIG. 1) for engaging cooperating internal threads 26 (FIG. 4) provided on the closure 10 as will be described in detail below.

The container 12, per se, does not necessarily form a part of the broadest aspects of the present invention. The body 14 of the container 12 may have any suitable configuration, and the container neck 20 may have a different cross-sectional size and/or shape than the container body 14. Alternatively, the container 12 may not have a neck 20 per se. Instead, the container 12 may consist of just a body with an opening. The container 12 may have a rigid wall or walls, or may have a somewhat flexible wall or walls.

The opening 24 at the top edge 22 of the container neck 20 may be sized to permit ice cubes or large chunks of ice to be placed easily into the reservoir for chilling the liquid therein. In one embodiment, the neck finish of the container 12 may be between about 53 mm and about 63 mm. and the exemplary container 12 may be sized to hold a volume of between about 22 oz. and about 26 oz. of liquid. The outer diameter of the container 12 may be sized to fit in a car cup holder, a bike bottle cage or a pocket of a backpack, for example. It will be appreciated that other dimensions of neck finishes and sizes of the container 12 are possible as well without departing from the spirit and scope of the present invention.

Figure 4:
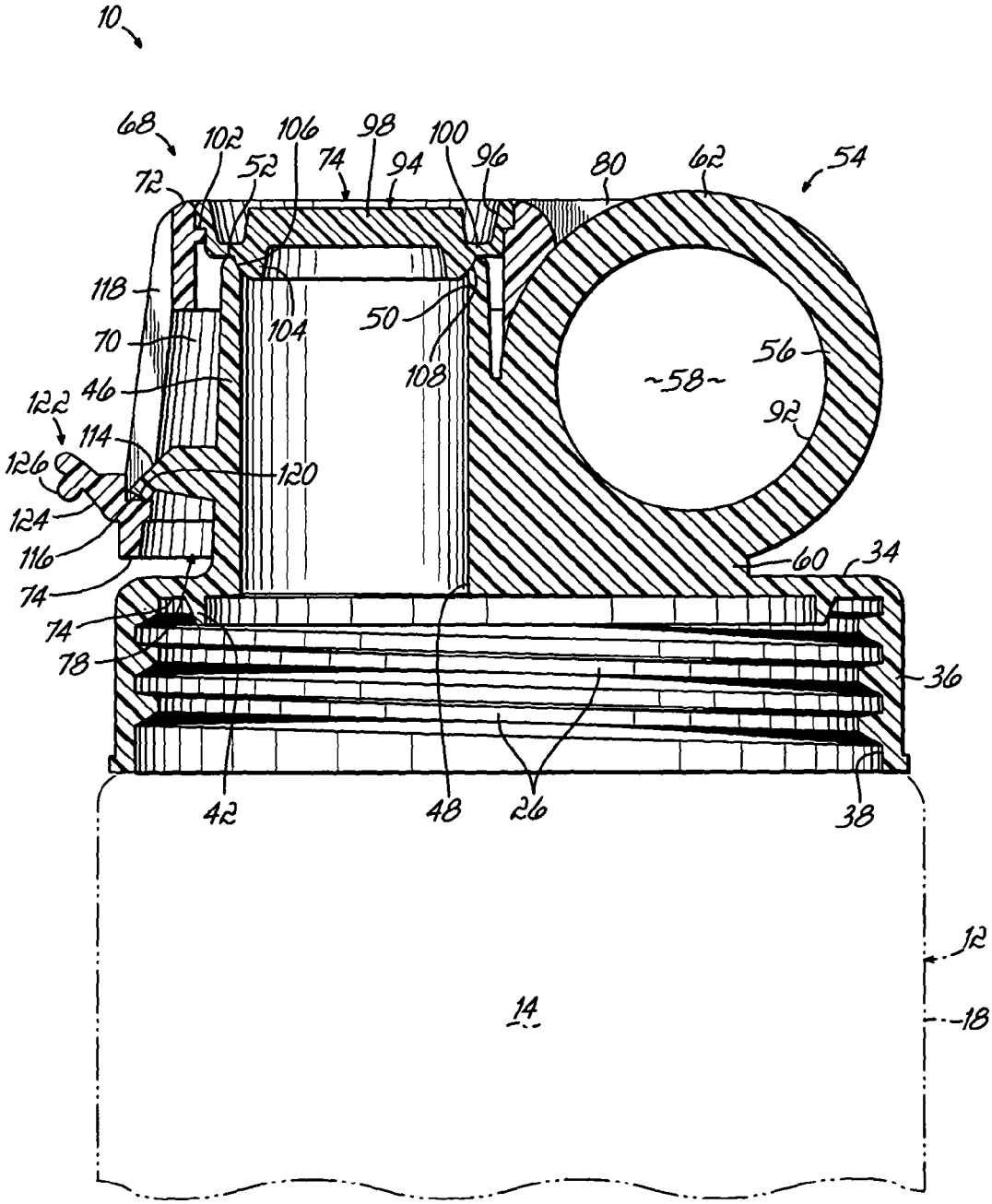
FIG. 4 is an enlarged cross-sectional view taken along line 4-4 of FIG. 1.

The closure 10 is configured to be removably secured to the neck 20 of the container 12. In one embodiment, the closure 10 is configured to be received over the neck 20 of the container 12 to seal with the top edge 22 of the container 12. The closure 10 includes a generally circular-shaped end wall 34 and an annular skirt wall 36 depending from the end wall 34. As shown in FIG. 4, an interior surface 38 of the skirt wall 36 includes the threads 26 that are configured to cooperate with the corresponding external threads 25 provided on the container neck 20 whereby the closure 10 may be secured to the container 12 by screwing the closure 10 onto the neck 20 of the container 12. A seal ring 42 (FIG. 4) is formed on an interior side 44 of the end wall 34 and is configured to engage the top edge 22 of the neck 20 to thereby seal the closure 10 in an essentially watertight, leak-proof manner, with the opening 24 of the container 12. It will be appreciated that other sealing structures well known in the art are possible for sealing the closure 10 with the container opening 24 without departing from the spirit and scope of the present invention.

In accordance with one aspect of the present invention, the closure 10 includes a generally tubular spout 46 extending upwardly from the end wall 34 of the closure 10. The spout 46 includes an inlet opening 48 provided in the end wall 34 of the closure 10 and an outlet opening 50 (FIG. 4) defined by a top edge 52 of the spout 46. The outlet opening 50 is in fluid communication with the reservoir when the closure 10 is secured to the container neck 20 so that liquid within the container 12 pours out of the spout 46 when a user tilts the container 12.

In one embodiment, the spout 46 is generally in the form of a cylinder with the top edge 52 of the spout 46 lying in a generally horizontal plane. The outlet opening 50 may have a diameter of about ¾ in. to provide a steady fluid flow through the spout 46 and also for easy cleaning. The spout 46 may have a dispensing axis that is generally parallel to, but offset from, a central longitudinal axis of the container 12. It is contemplated that other cross-sectional shapes of the spout 46 and other dimensions and orientations of the outlet opening 50 are possible as will be appreciated by those of ordinary skill in the art. Accordingly, the spout 46 and outlet opening 50 may each have a variety of different shapes and sizes which are a matter of design choice open to a variety of possibilities.

In accordance with another aspect of the present invention, the closure includes a loop member 54 extending upwardly from the end wall 34 of the closure 10. The loop 54 may include a generally tubular wall 56 that defines an opening 58 therethrough. The opening 58 may have an axis that is generally transverse to the dispensing axis of the outlet opening 50 and the central longitudinal axis of the container 12. The loop 54 may be sized to receive a user's finger or, alternatively, attachment hardware such as a clip, hook or strap (not shown) extending through the loop 54 for grasping the container 12 and/or securing the container 12 to an article of clothing or a backpack, for example.

In one embodiment, the loop 54 is a closed loop in the form of a cylinder and has a generally circular cross-sectional shape. It is contemplated that the loop 54 need not be completely closed and may have other cross-sectional shapes and sizes that would permit the container 12 to be grasped by a user's finger or attached to another article with attachment hardware extending through the loop 54. The loop 54 may be positioned adjacent the spout 46 and connected to the spout 46 and the end wall 34 through an integral connecting web 60. Alternatively, it is contemplated that the loop 54 may be spaced from the spout 46 so that a gap is provided between the spout 46 and the loop 54.

The loop 54 may include an arcuate rib 62 provided on an outer arcuate surface 64 of the loop 54. In one embodiment, the rib 62 extends about the outer surface 64 (FIG. 1A) of the loop 54 and is positioned generally centrally between opposite side edges 66 (FIG. 1A) of the loop 54. The rib 62 may be generally continuous along its length or, alternatively, it may be interrupted or discontinuous or have a variety of other configurations as a matter of design choice.

The closure 10, including the end wall 34, skirt wall 36, spout 46 and loop 54, may be molded from suitable thermoplastic material or materials. For example, in one embodiment, the closure 10 may be molded as an integral component from a polypropylene copolymer. Alternatively, the closure 10 may be molded from one or more of the same or different thermoplastic materials to provide a desired soft feel or texture to the closure 10.

Figure 1A:
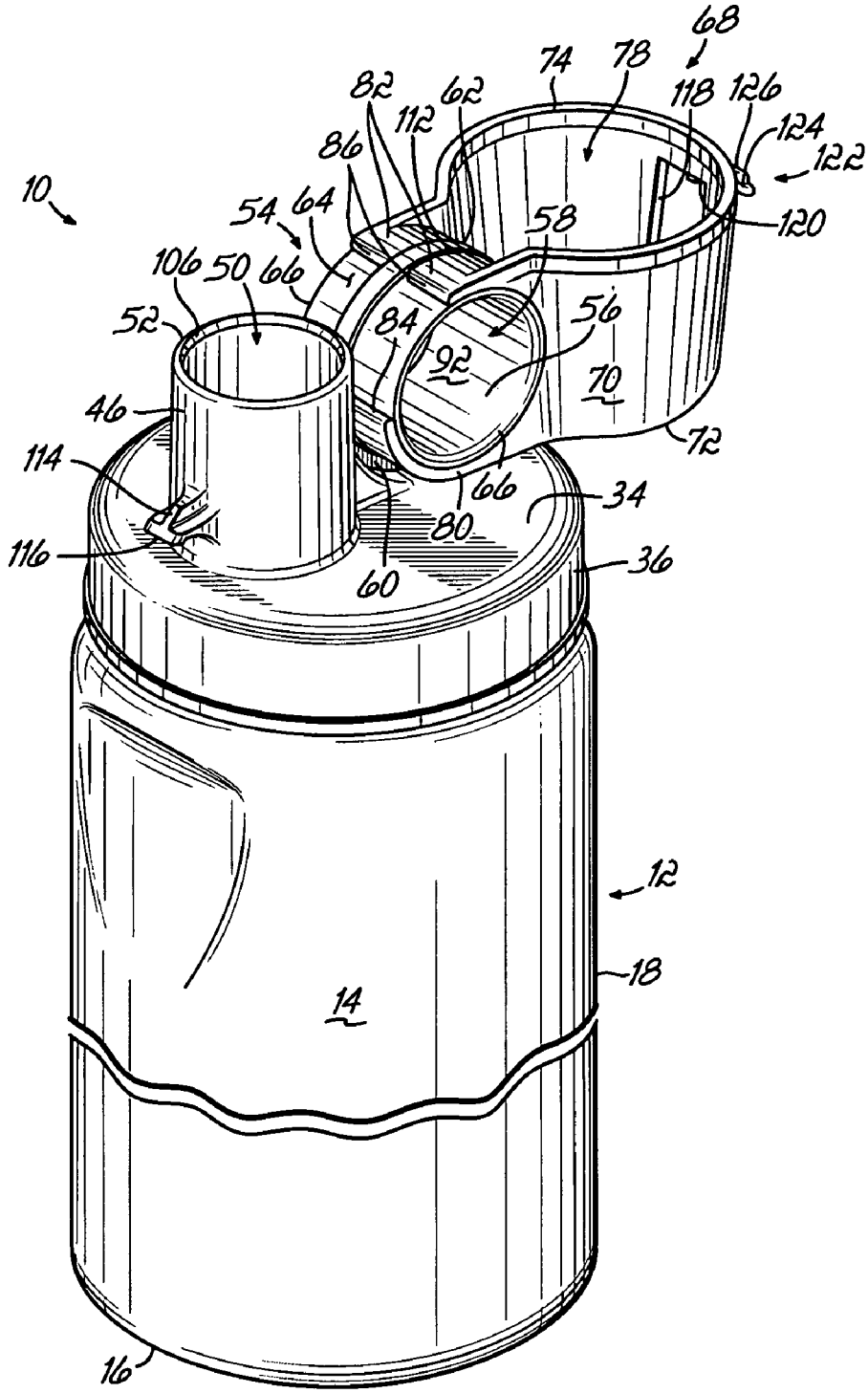
FIG. 1A is a view similar to FIG. 1 showing the flip cap oriented in an open position.

In accordance with yet another aspect of the present invention, a flip cap 68 is provided on the closure 10 to selectively cover the spout 46 when the spout is not in use. In one embodiment, the flip cap 68 is supported for rotational movement on the loop 54 and is movable between a closed position in which the spout 46 is covered (FIGS. 1, 1B, 2 and 4) and an open position in which the spout 46 is exposed (FIGS. 1A and 3).

In one embodiment, the flip cap 68 includes a generally tubular sidewall 70 that tapers slightly outwardly from a top edge 72 of the flip cap 68 (FIGS. 1 and 4) to a bottom edge 74 thereof. The flip cap 68 includes an upper opening 76 (FIGS. 1 and 4) defined by the top edge 72 and an opposite lower opening 78 defined by the bottom edge 74. The flip cap 68 further includes a pair of opposing arcuate connector members 80, 82 in the form of fingers or jaws that extend or project outwardly from the sidewall 70 of the flip cap 68 and are configured to releasably engage with the loop 54.

Figure 3:
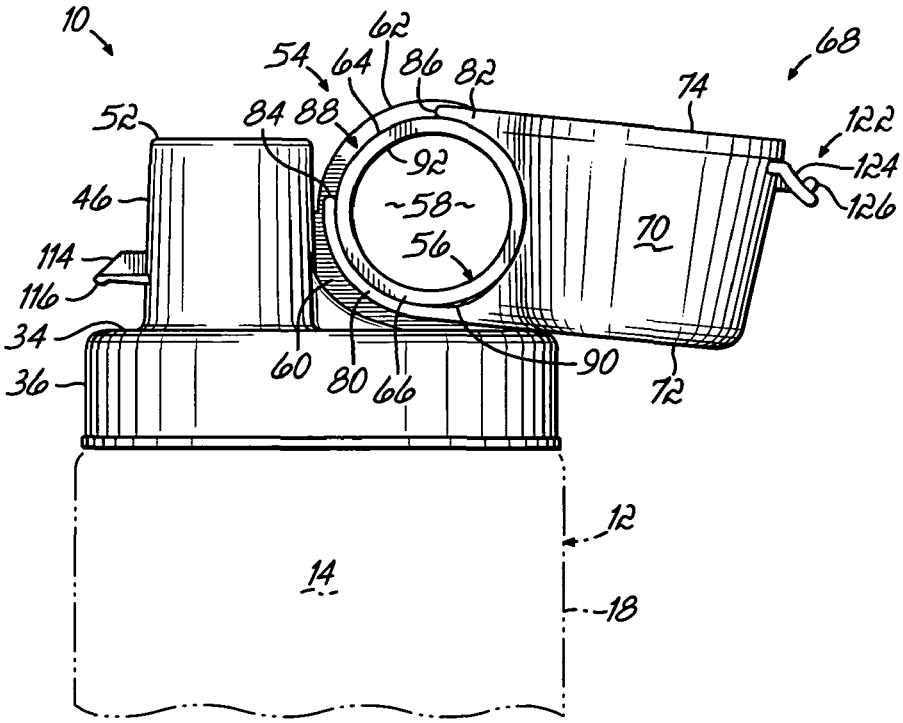
FIG. 3 is a view similar to FIG. 2 showing the flip cap oriented in the open position.

The connector members 80, 82 have respective free ends 84, 86 that are spaced apart and define a gap 88 therebetween (FIGS. 1 and 3). The gap 88 is sized so that the flip cap 68 can be snapped onto the loop 54 by passing the loop 54 through the gap 88. At least one of the connector members 80, 82 may be sufficiently resilient so as to flex away from the other connector member when the loop 54 is passed through the gap 88 and thereafter flex back toward the other connector member to secure the flip cap 68 onto the loop 54.

In one embodiment, each of the pair of opposing connector members 80, 82 has a radius of curvature that generally corresponds to the radius of curvature of the loop 54. The connector members 80, 82 may be positioned to engage the outer arcuate surface 64 of the loop 54 so that the flip cap 68 is rotatably supported by the loop 54 for movement between the open and closed positions. In this way, the loop 54 isolates the connector members 80, 82 from a user's finger or attachment hardware passing through the loop 54 so that the user's finger or attachment hardware does not interfere with movement of the flip cap 68 or cause unintentional opening of the flip cap 68. Moreover, the surface contact of the connector members 80, 82 with the loop 54 provides a bearing surface that resists breakage of the pivotal connection formed between the flip cap 68 and the loop 54.

Figure 2:
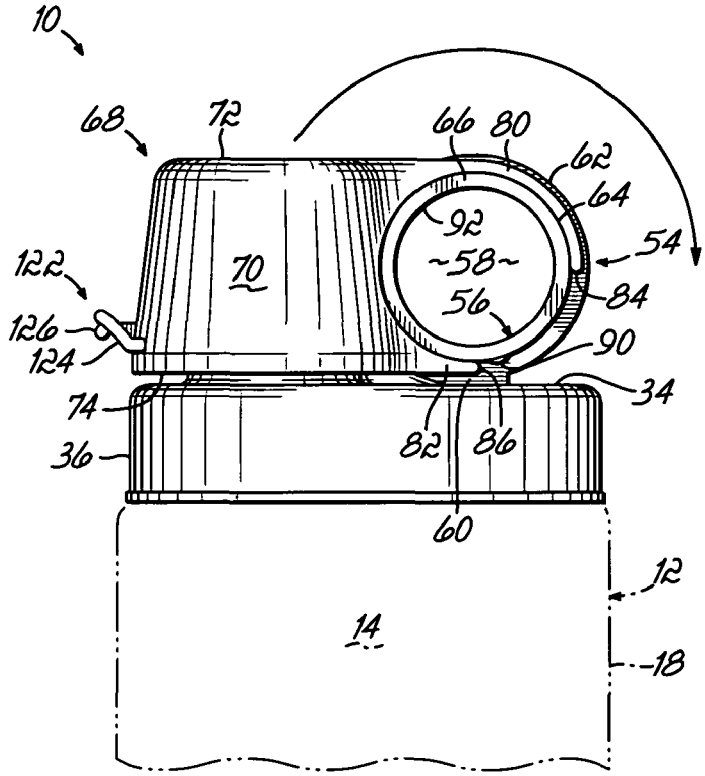
FIG. 2 is an enlarged side elevational view of the closure of FIG. 1, showing the flip cap oriented in the closed position.

As shown in FIG. 2, one or more detents 90 (one shown) in the form of a rib or other suitable structure project outwardly from the outer arcuate surface 64 of the loop 54 on opposite sides of the annular rib 62. The detents 90 are configured to frictionally engage the connector member 80 as it travels about the loop 54 when the flip cap 68 is moved to the open position as shown in FIG. 3. The frictional engagement of the detents 90 with the connector member 80 aid in keeping the flip cap 68 in the open position when the user desires access to the spout 46.

While a pair of opposite arcuate connector members 80, 82 is shown, it is contemplated that only a single connector member may be provided in an alternative embodiment. In this alternative embodiment, the arcuate length of one of the connector members 80 or 82 may be increased so that the loop 54 is passed through a gap formed between a free end of the connector member and the sidewall 70 of the flip cap 68, for example. Also, while the flip cap 68 is shown with the arcuate connector members 80, 82 positioned on the outer surface 64 of the loop 54, it is contemplated that in an alternative embodiment, one or more connector members may be provided on the flip cap 68 that engage the inner arcuate surface 92 of the loop 54 instead. Accordingly, those skilled in the art will appreciate that other pivotal connection structures are possible for rotatably supporting the flip cap 68 on the loop 54 without departing from the spirit and scope of the present invention.

In accordance with another aspect of the present invention, a plug seal 94 is positioned in the upper opening 76 of the flip cap 54 adjacent the top edge 72 of the cap sidewall 70. The plug seal 94 includes an outer annular wall 96, a central plug seal body 98 and an annular connecting web 100 extending between the annular wall 96 and the plug seal body 98 as shown in FIGS. 1 and 4. As shown in FIG. 4, the flip cap 68 includes a radially inwardly directed annular shoulder 102 for securing the plug seal 94 adjacent the top edge 72 of the flip cap 68. The central plug seal body 98 may have a depending annular sealing wall 104 as shown in FIG. 4 that is configured to engage and seal with the top edge 52 of the spout 46. The top edge 52 of the spout 46 may have a chamfered portion 106 that sealingly engages with a radially outward sealing surface 108 of the annular sealing wall 104. The flip cap 68 and spout 46 are configured so that as the flip cap 68 is moved to the closed position as shown in FIGS. 1, 1B, 2 and 4, the central plug seal body 98 automatically sealingly engages with the spout 46 to prevent undesired leakage of liquid from the outlet opening 50.

According to another aspect of the present invention, the flip cap 68 and plug seal 94 are integrally molded in a two-shot molding operation. For example, the flip cap 68 may be molded during a first shot of a two-shot molding process from a suitable thermoplastic material, such as a polycarbonate. The flip cap 68 may have a generally transparent color and a texture provided on its outer surface. During the second shot of the two-shot molding process, the plug seal 94 is formed and integrally attached to the radially inwardly directed annular shoulder 102 of the flip cap 68. The plug seal 94 may be molded from a suitable material such as a thermoplastic elastomer, for example, and have a desired color. Alternatively, it is contemplated that the flip cap 68 and plug seal 94 may be formed as separate components and connected together through any suitable method to securely mount the plug seal 94 to the flip cap 68.

Figure 1B:
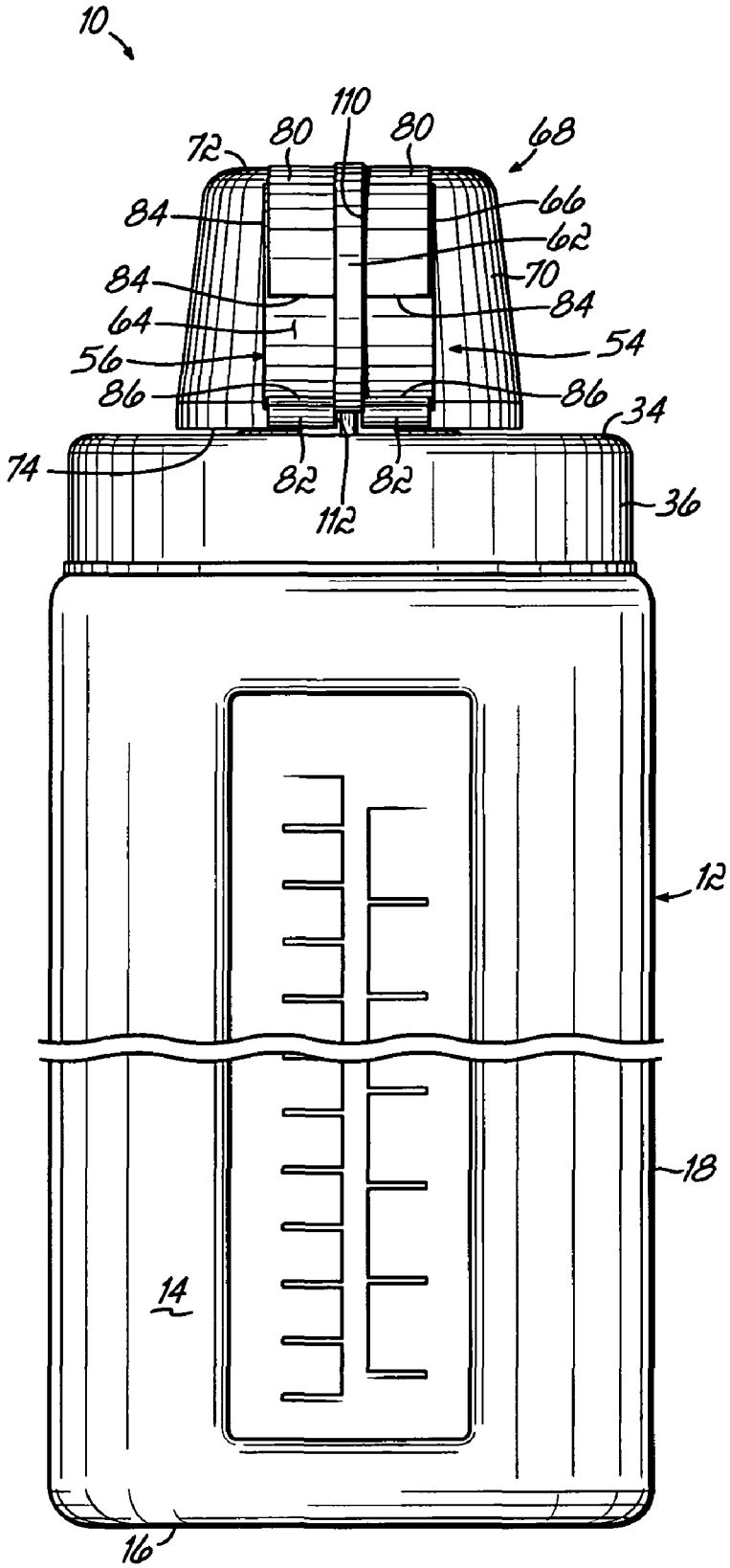
FIG. 1B is a partial rear elevational view of the container shown in FIG. 1.

As shown in FIGS. 1, 1A and 1B, each of the arcuate connector members 80, 82 may include a respective arcuate slot 110, 112 extending toward the free ends 84, 86 of the connector members 80, 82. The slots 110, 112 are configured to receive the annular rib 62 of the loop 54 therein so as to guide the flip cap 68 in proper alignment with the spout 46 as the flip cap 68 is rotated to the closed position. In this way, proper alignment of the plug seal 94 with the top edge 52 of the spout 46 is maintained as the plug seal 94 is brought into engagement with the top edge 52 of the spout 46 to seal the spout.

In one embodiment, a latch member 114 projects outwardly from the spout 46 and terminates in a chamfered surface 116 as shown in FIGS. 1A, 3 and 4. The flip cap 68 is provided with an elongated opening 118 (FIGS. 1 and 4) having a locking surface 120 (FIGS. 1A and 4) provided at a lower end thereof. As the flip cap 68 is moved to the closed position, the chamfered surface 116 of the latch member 114 is brought into releasable locking engagement with the locking surface 120 of the flip cap 68 as shown in FIG. 4.

The flip cap 68 includes a finger tab 122 for enabling a user to lift the flip cap 68 out of engagement with the latch member 114 to open the spout 46. The finger tab 122 includes an inwardly angled surface 124 for more easily allowing a user's finger to slide beneath the tab 122. Finger tab 122 further includes a projection 126 beneath the inwardly angled surface 124 for allowing the user's finger to easily grip the finger tab 122 and lift it upwardly. It will be appreciated that other suitable locking structures known to those skilled in the art are possible as well without departing from the spirit and scope of the present invention.

In an alternative embodiment, the closure 10 does not include the spout 46. According to this alternative embodiment, an outlet opening (not shown) is formed in the end wall 34 of the closure 10 in fluid communication with the reservoir when the closure 10 is secured is to the container neck 20. The flip cap 68 may be configured to cover, and possibly seal, the outlet opening (not shown) formed in the end wall 34 of the closure 10.

In use, the closure 10 may be unscrewed from the neck 20 of the container 12 and the container may be filled with a desired liquid or beverage and ice, for example. During storage and transportation with liquid contained in the container 12, the flip cap 68 is moved to the closed position so that the plug seal 94 forms an essentially watertight and leak-proof seal with the top edge 52 of the spout 46, or alternatively, an outlet opening formed in the end wall 34 of the closure 10. When it is desired to drink or dispense liquid from the container 12, the flip cap 68 is flipped to the open position shown in FIGS. 1A and 3 by lifting tab 122 with a finger to expose the spout 46 or outlet opening formed in the end wall 34 of the closure 10. When the user is finished dispensing liquid from the container 12, the flip cap 68 is flipped back to the closed position to cover the spout 46 or outlet opening formed in the end wall 34 of the closure 10 and provide an essentially leak-proof seal with the spout 46 or outlet opening formed in the wall 34 of the closure.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of Applicants' general inventive concept.

Having described the invention, we claim:

1. A closure for use with a liquid container, comprising:
an end wall;
a skirt wall depending from the end wall;
an outlet opening associated with the end wall;
a loop member extending from the end wall and defining an opening therethrough having a generally horizontal axis, the end wall, skirt wall and loop member being integrally molded as a unitary component;
a cap supported for rotational movement on the loop member, the cap being movable between a first position in which the outlet opening is covered by the cap and a second position in which the outlet opening is exposed; and
at least one arcuate connector member supported by the cap, the at least one connector member having a free end that is configured to flex relative to the cap for engagement of the at least one connector member about the loop member to releasably connect the cap to the loop member.

2. The closure of claim 1 further comprising a spout extending from the end wall and terminating in the outlet opening, the spout defining a flow path through the end wall to the outlet opening.

3. The close of claim 2 wherein the spout is covered by the cap in the first position of the cap and exposed in the second position of the cap.

4. The closure of claim 2 wherein the cap is configured to seal with and close the outlet opening of the spout when the cap is moved to the first position.

5. The closure of claim 4 wherein the outlet opening of the spout is open when the cap is moved to the second position.

6. The closure of claim 1 wherein the loop member is located adjacent the spout.

7. The closure of claim 1 wherein the loop member comprises a closed loop.

8. The closure of claim 7 wherein the closed loop has a generally circular cross-sectional shape.

9. The closure of claim 2 wherein the cap comprises:
a generally tubular cap wall; and
a plug seal supported by the cap wall, the plug seal being configured to seal with and close the outlet opening of the spout when the cap is moved to the first position.

10. The closure of claim 9 wherein the cap wall is made of a first material and the plug seal is made of a second material.

11. The closure of claim 1 further comprising a pair of opposing arcuate connector members.

12. The closure of claim 1 wherein the at least one arcuate connector member is located outwardly of the loop member.

13. The closure of claim 11 wherein the pair of opposing arcuate connector members are located outwardly of the loop member.

14. The closure of claim 1 further comprising an arcuate rib projecting outwardly from the loop member.

15. The closure of claim 14 further comprising a slot formed in the at least one connector member, wherein at least a portion of the annular rib is located within the slot.

16. The closure of claim 1 further comprising a detent projecting outwardly from the loop member, wherein the detent is configured to engage the at least one connector member when the cap is moved to the second position.

17. The closure of claim 1 further comprising a latch member projecting outwardly from the spout, wherein the latch member is configured to releasably engage the cap when the cap is moved to the first position.

18. The closure of claim 17 further comprising a tab member projecting from the cap member.

19. The closure of claim 1 further comprising a liquid container having a liquid receiving interior and an opening, wherein the closure is configured to engage the liquid container to close the opening.

20. A closure for use with a liquid container, comprising:
an end wall;
A skirt wall depending from the end wall;
a spout extending upwardly from the end wall and terminating in an outlet opening, the spout defining a flow path through the end wall to the outlet opening;
a loop member extending upwardly from the end wall and defining an opening therethrough having a generally horizontal axis, the end wall, skirt wall and loop member being integrally molded as a unitary component;
a cap supported for rotational movement on the loop member, the cap being movable between a first position in which the spout is covered by the cap and a second position in which the spout is exposed; and
at least one arcuate connector member supported by the cap, the at least one connector member having a free end that is configured to flex relative to the cap for engagement of the at least one connector member about the loop member to releasably connect the cap to the loop member, the at least one arcuate connector member being located outwardly of the loop member.

21. The closure of claim 20 wherein the loop member is located adjacent the spout.

22. The closure of claim 20 wherein the loop member comprises a closed loop.

23. The closure of claim 20 wherein the cap comprises:
a generally tubular cap wall; and
a plug seal supported by the cap wall, the plug seal being configured to seal with and close the outlet opening of the spout when the cap is moved to the first position.

24. The closure of claim 23 wherein the cap wall is made of a first material and the plug seal is made of a second material.

25. The closure of claim 20 further comprising an arcuate rib projecting outwardly from the loop member.

26. The closure of claim 25 further comprising a slot formed in the at least one connector member, wherein at least a portion of the annular rib is located within the slot.

27. The closure of claim 20 further comprising a detent projecting outwardly from the loop member, wherein the detent is configured to engage the at least one connector member when the cap is moved to the second position.

28. The closure of claim 20 further comprising a liquid container having a liquid receiving interior and an opening, wherein the closure is configured to engage the liquid container to close the opening.

29. A closure for use with a liquid container, comprising:

an end wall;

a skirt wall depending from the end wall;

a spout extending upwardly from the end wall and terminating in an outlet opening, the spout defining a flow path through the end wall to the outlet opening;

a loop member extending upwardly from the end wall and defining an opening therethrough having a generally horizontal axis, the end wall, skirt wall and loop member being integrally molded as a unitary component;

a cap supported for rotational movement on the loop member, the cap being movable between a first position in which the spout is covered by the cap and a second position in which the spout is exposed and comprising:

a generally tubular cap wall; and a plug seal supported by the cap wall, the plug seal being configured to seal with and close the outlet opening of the spout when the cap is moved to the first position; and a pair of opposing arcuate connector members supported by the cap, at least one of the pair of connector members having a free end that is configured to flex relative to the cap for engagement of the pair of connector members about the loop member to releasably connect the cap to the loop member.

30. The closure of claim 29 wherein the cap wall is made of a first material and the plug seal is made of a second material.

31. The closure of claim 29 wherein the loop member is located adjacent the spout.

32. The closure of claim 29 wherein the loop member comprises a closed loop.

33. The closure of claim 29 wherein the pair of opposing arcuate connector members are located outwardly of the loop member.

34. The closure of claim 29 further comprising an arcuate rib projecting outwardly from the loop member.

35. The closure of claim 34 further comprising a slot formed in each of the pair of connector members, wherein at least a portion of the annular rib is located within the slot.

36. The closure of claim 29 further comprising a detent projecting outwardly from the loop member, wherein the detent is configured to engage the at least one connector member when the cap is moved to the second position.

37. The closure of claim 29 further comprising a liquid container having a liquid receiving interior and an opening, wherein the closure is configured to engage the liquid container to close the opening.

* * * * *

UNITED STATES PATENT AND TRADEMARK OFFICE

CERTIFICATE OF CORRECTION

PATENT NO. : 7,753,240 B2
APPLICATION NO. : 11/342080
DATED : July 13, 2010
INVENTOR(S) : Leoncavallo et al.

It is certified that error appears in the above-identified patent and that said Letters Patent is hereby corrected as shown below:

In column 5, line 40, change "with the connector member 80 aid in keeping" to --with the connector member 80 aids in keeping--.

In column 6, line 64, change "when the closure 10 is secured is to the container" to --when the closure 10 is secured to the container--.

In column 7, line 55, claim 3, change "The close of claim 2" to --The closure of claim 2--.

In column 8, line 15, claim 13, change "arcuate connector members are located outwardly" to --arcuate connector members is located--.

In column 8, line 38, claim 20, change "A skirt wall depending from the end wall;" to --a skirt wall depending from the end wall--.

In column 10, line 15, claim 33, change "arcuate connector members are located" to --arcuate connector members is located--.

Signed and Sealed this

Twenty-sixth Day of October, 2010

David J. Kappos

David J. Kappos
*Director of the United States Patent and Trademark Office*